US005915860A

United States Patent [19]

Laurent

[11] Patent Number: 5,915,860

[45] Date of Patent: Jun. 29, 1999

[54] CARTRIDGE AND ROLLER FOR A CONSUMABLE RIBBON, RECEIVING APPARATUS, AND ROTATIONAL ROLLER COUPLING METHOD

[75] Inventor: Jean-Marie Laurent, Gonesse, France

[73] Assignee: IER, Suresnes, France

[21] Appl. No.: 08/737,155

[22] PCT Filed: Oct. 12, 1995

[86] PCT No.: PCT/FR95/01340

§ 371 Date: Feb. 19, 1997

§ 102(e) Date: Feb. 19, 1997

[87] PCT Pub. No.: WO96/11872

PCT Pub. Date: Apr. 25, 1996

[30] Foreign Application Priority Data

Oct. 14, 1994 [FR] France ..... 94 12310

[51] Int. Cl.[6] ..... B41J 35/28

[52] U.S. Cl. ..... 400/242; 400/208; 400/234

[58] Field of Search ..... 400/208, 234, 400/250, 242, 246, 243, 207, 206; 242/422.4, 571.8

[56] References Cited

U.S. PATENT DOCUMENTS

| | | | |
|---|---|---|---|
| 3,977,511 | 8/1976 | Hengelhaupt | 400/208 |
| 4,350,452 | 9/1982 | Dials et al. | 400/208 |
| 4,687,358 | 8/1987 | Saitou | 400/208 |
| 4,722,493 | 2/1988 | Parry et al. | 242/96 |
| 4,756,635 | 7/1988 | Frerichs | 400/208 |
| 4,795,106 | 1/1989 | Weiss et al. | 242/72 R |
| 5,085,531 | 2/1992 | Gillio | 400/234 |
| 5,553,952 | 9/1996 | Umbach | 400/208 |
| 5,718,524 | 2/1998 | Nordstrom et al. | 400/248 |

FOREIGN PATENT DOCUMENTS

| | | | |
|---|---|---|---|
| 0036928 | 10/1981 | European Pat. Off. . | |
| 0047375 | 3/1982 | European Pat. Off. . | |
| 0294792 | 12/1988 | European Pat. Off. . | |
| 3418734 | 11/1985 | Germany . | |
| 3517616 | 11/1985 | Germany . | |
| 8628559 | 2/1988 | Germany . | |
| 3641255 | 10/1992 | Germany . | |
| 62-263083 | 11/1987 | Japan | 400/242 |
| 951156 | 3/1964 | United Kingdom . | |

OTHER PUBLICATIONS

*IBM Technical Disclosure Bulletin*, "Ribbon Back Check Mechanism", vol. 27, No. 12, May 1985, pp. 6855–6856.

*Primary Examiner*—Christopher A. Bennett
*Attorney, Agent, or Firm*—Greer, Burns & Crain, Ltd

[57] ABSTRACT

A roller for a wound ribbon such as a printer ink ribbon may be rotationally coupled by pushing the projections or teeth of a wheel on a drive spindle into a soft material defining part of the bore in the roller. A spring blade prevents the wheel from freely rotating and provides a snap-in feeling. The roller may be part of a cartridge having members for locking the rollers in a position in which the ribbon tension is optimized. The roller and spindle may be coupled in any relative angular position, and the rollers may thus be locked. Release is automatic when the cartridge is full engaged. The ribbon may therefore be more readily installed in an optimized matter.

54 Claims, 6 Drawing Sheets

CARTRIDGE AND ROLLER FOR A CONSUMABLE RIBBON, RECEIVING APPARATUS, AND ROTATIONAL ROLLER COUPLING METHOD

BACKGROUND OF THE INVENTION

The present invention relates to a cartridge for a consumable ribbon.

The present invention also relates to a roller for winding a ribbon from one of its ends into such a cartridge.

The present invention also relates to a ribbon-consuming apparatus, such as a printer, in particular a ticket office printer.

The present invention further relates to a method for rotationally coupling such a roller with a spindle for supporting and driving this roller.

The ribbon in question may be an ink ribbon which the apparatus consumes as it prints documents by a thermal printing process.

Printers issuing in particular tickets, reservation documents and other tickets for people travelling by air or by other means of transport are called ticket office printers.

In this type of printer, the ink ribbon is relatively wide and the lines are printed along the width of the ribbon, and printing is carried out in successive lines in the direction of the width of the ribbon perpendicular to the direction of unwinding of the ribbon and of the document to be printed. However, the invention is in no way limited to this configuration.

Ribbon-consuming apparatuses generally contain two rotating spindles to support a roller for unwinding the new ribbon and a roller for taking up the used ribbon respectively. It is necessary to carry out a rotational coupling between the take-up roller and the corresponding spindle which is a motor spindle, so that the take-up roller is entrained in the direction in which the ribbon is pulled towards the roller.

In many cases, it is also necessary to carry out a rotational coupling between the unwinding roller and the corresponding spindle, for example in order that the spindle transmits to the roller a braking torque corresponding to a predetermined tension of the ribbon. The possibility may also be provided, after first using all or part of the length of the ribbon, of rewinding the ribbon onto the unwinding roller in order to use the ribbon again, which will provide a still acceptable quality of printing. In order to carry out such a rewinding process, the unwinding spindle must also be equipped with a rapid reverse motorization.

When a new ribbon is being inserted, operations are made easier if the ribbon is contained in a cartridge. It is also possible for the new ribbon and the two rollers to be positioned on a loader, made for example of cardboard, which gives the rollers and the ribbon the exact position allowing the whole to slide directly into the ribbon-consuming apparatus by simple translation of the whole parallel to the axes of the rollers.

However, even with these simplifying means, the operator must still carry out the rotational coupling between each roller and its spindle whilst holding the strip along a path which is sufficiently precise for a region of the ribbon located between the two rollers to be inserted between a printing head and a printing surface. Moreover, in order to carry out the two rotational couplings, it is often necessary to turn the rollers slightly in order to find the position in which locking is possible, and this slight rotation of the rollers can only be carried out in the direction of release of the region of the ribbon which has to be placed between the printing head and the printing surface, which complicates the engagement and creates unfavourable initial operating conditions.

The aim of the invention is to remedy these disadvantages and in particular to allow better engagement of the new ribbon, and to provide improved initial conditions for using the ribbon in the receiving apparatus.

SUMMARY OF THE INVENTION

According to the invention, the interchangeable cartridge comprising a casing rotationally supporting two rollers onto each of which a ribbon is wound from one of its ends, each roller including an axial bore so that it can be slid onto a spindle of a receiving apparatus, at least a first one of the rollers including means for rotational coupling with the corresponding spindle is characterized in that the rotational coupling means comprise a soft material defining at least part of the bore of the first roller.

By virtue of the means for coupling using soft material, the rollers no longer have to take up a precise position in order to be rotationally coupled relative to the spindles. The soft material of the rollers is able to provide the coupling with very varied means provided on the spindles. In particular these may be projections or one or more claws which deform the soft material or penetrate the soft material sufficiently for the rotational coupling to be reliable.

The soft material may, for example, consist of cardboard or of a flexible, plastic material which may be an elastomer. The coupling means are thus very economical to produce, and several types of roller may be accepted by the same spindle.

It is advantageous for the cartridge to contain disengageable means in order to prevent each roller from turning in the direction of release of the strip.

Before fitting the cartridge, these means keep the two rollers in a position in which the ribbon is under tension over the region where it must be located relative to an operating station that is to say, for example, between a printing head and a printing surface. Due to the fact that the coupling means according to the invention do not require any predetermined position of the rollers relative to the spindles, the cartridge may be inserted in an optimal manner, after which the disengageable means are disengaged in order to allow the rollers to turn under the action of the spindles.

This disengagement may be carried out automatically when insertions of the cartridge is on the point of being completed, for example by means of a member provided on the apparatus and actuating the disengageable means when insertion of the cartridge is complete.

According to a second aspect of the invention, the roller for a cartridge according to the first aspect, equipped with a bore and comprising a tube made of relatively rigid material and means for rotational coupling with a driving spindle belonging to an apparatus capable of receiving the cartridge, is characterized in that the rotational coupling means comprise a soft material which is fixed to the tube and defines at least part of the bore of the roller.

According to a third aspect of the invention, the ribbon-consuming apparatus, comprising two spindles at least one of which is a motor spindle, in order to receive two rollers respectively for unwinding and for taking up the ribbon consumed by the apparatus, the motor spindle having means for rotational coupling with the corresponding roller, is characterized in that the coupling means are designed in order to allow coupling irrespective of the angular position in which the corresponding roller is engaged on the motor spindle.

The invention also relates to the combination of an apparatus according to the third aspect and a cartridge according to the first aspect.

According to a fourth aspect of the invention, the method of fitting two rollers, each supporting one of the ends of a ribbon, into an apparatus consuming this ribbon, by sliding two spindles of the apparatus each into a central bore of one of the rollers while rotationally coupling at least one of the ribbon rollers with a corresponding one of the spindles, is characterized in that by sliding them in, a projection provided on the spindle is made to penetrate a soft material defining at least part of the bore of the roller.

Preferably, by sliding the roller onto the spindle, a coupling member is made to pivot, which member is fitted so as to rotate on the spindle and consists of at least two successive projections, one of which is pushed by the leading edge of the roller, as a result of which the other projection, initially retracted, in its turn interferes with the roller, penetrating the soft material constituting at least part of the bore of the roller.

Other features and advantages of the invention will emerge from the description below relating to non-limiting examples.

DETAILED DESCRIPTION OF THE INVENTION

Figure 1:
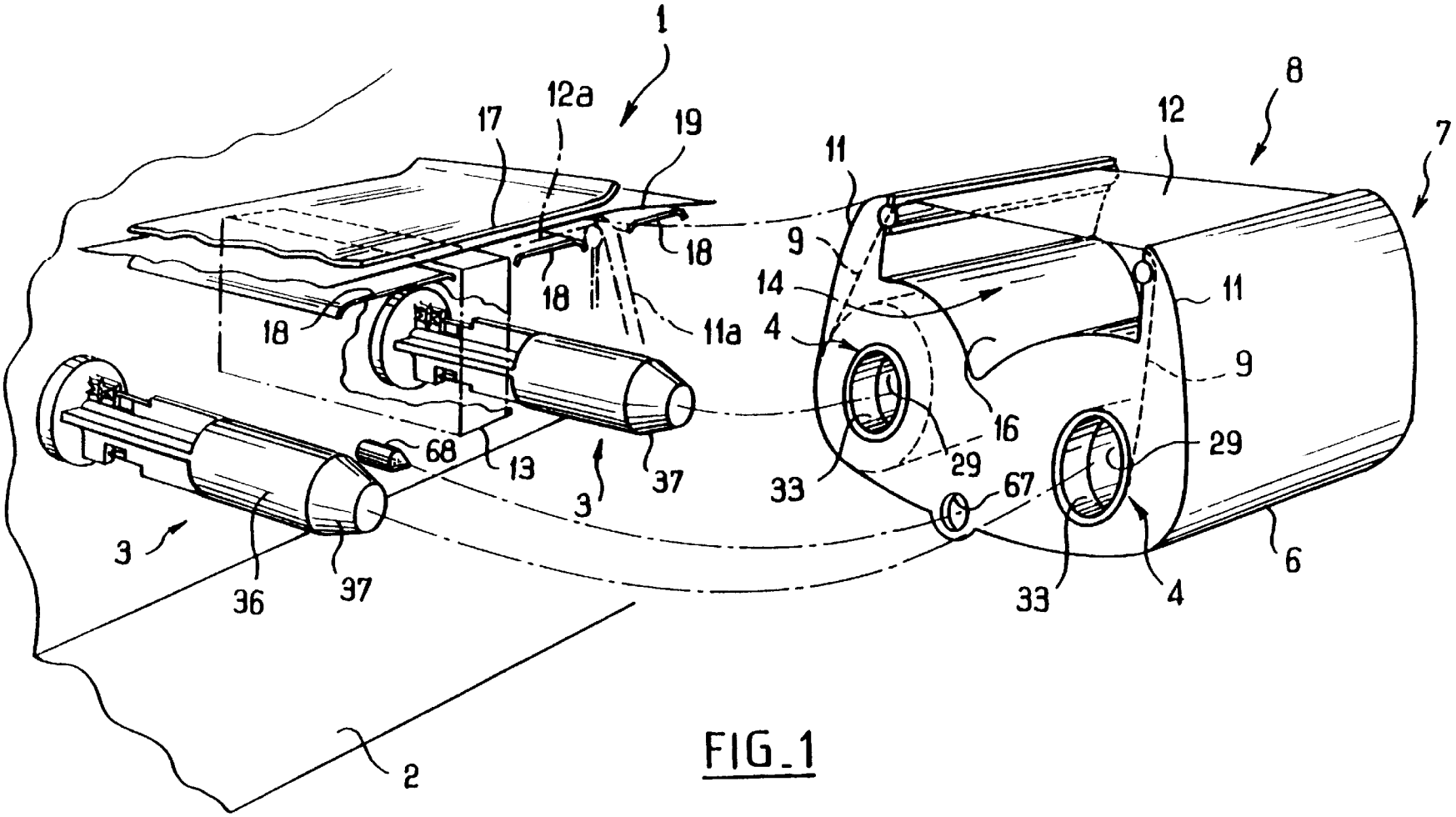
FIG. 1 is a perspective schematic view showing a cartridge in accordance with the invention ready to be inserted into a printer in accordance with the invention, represented with torn away portions

In the example represented in FIG. 1, the printer 1 contains in a housing 2 two spindles 3 which are rotationally supported in the housing 2 along parallel axes of rotation. Each spindle 3 is intended to slide into two tubular rollers 4 rotationally supported along parallel axes in the casing 6 of a cartridge 7 which can be fitted interchangeably in the housing 2 of the printer 1. In the casing 6, an ink ribbon 8 is wound from a first end onto one of the rollers 4 and from the other end onto the other roller 4. Starting from each roller 4, the ribbon 8 follows a path 9 as far as the end of a respective lip 11 defined by the casing 6. Between the two lips 11, a region 12 of the ribbon 8 is exposed for use. The printer 1 contains in addition a printing head 13 which, when the cartridge is inserted, fits into a space 14 between the exposed region 12 of the ribbon 8 and a closure wall 16 which the casing 6 exhibits facing the region 12.

A printing surface 17 located opposite the printing head 13, as well as various guides 18, define a path for the paper 19 or other material which must be printed on. When the cartridge 7 is inserted, the exposed region 12 of the ribbon 8 is located between the path for the paper 19 and the printing head 13, as illustrated by the dot-dash line 12*a,* one of the lips assuming position 11*a*.

Figure 2:
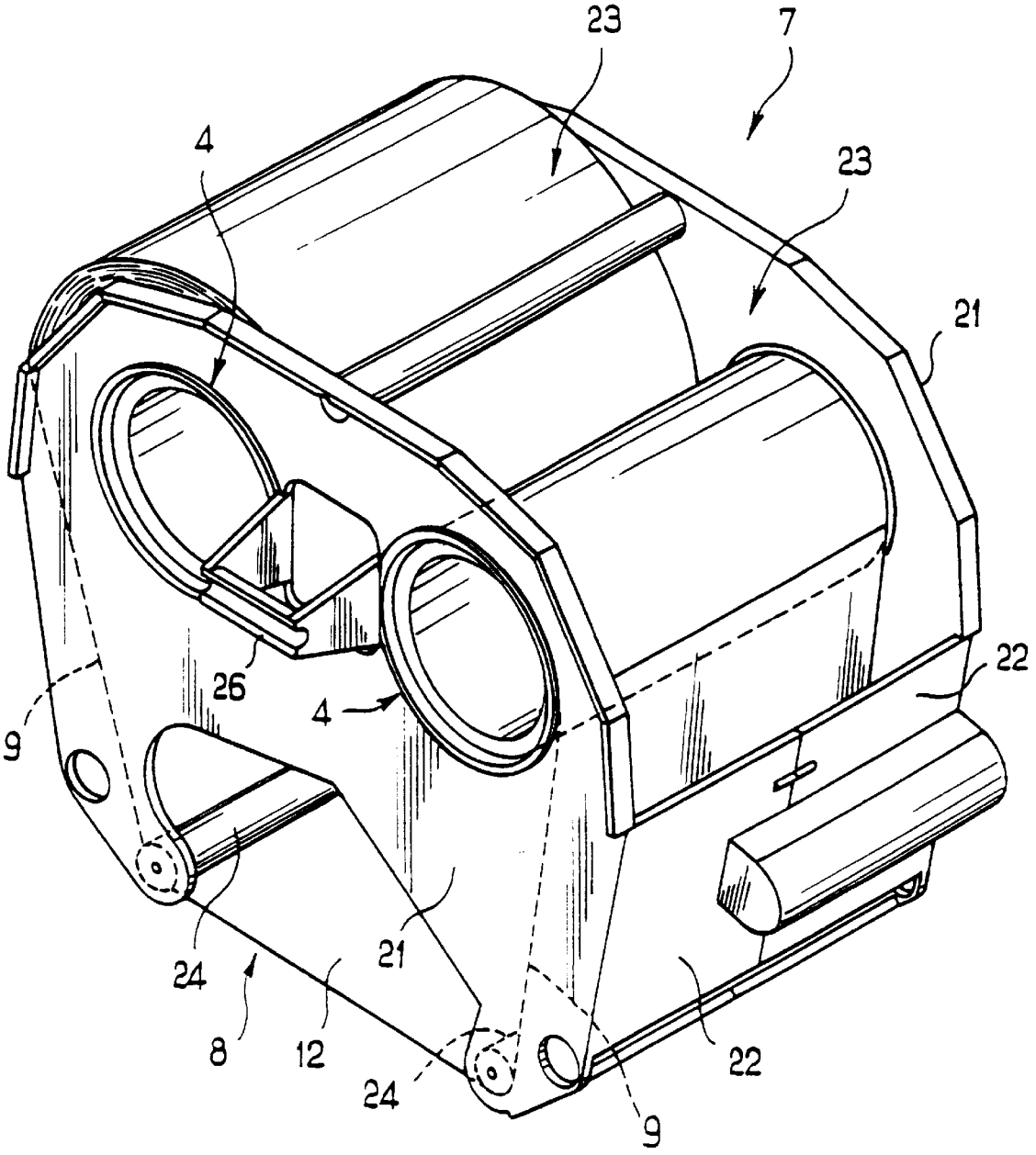
FIG. 2 is a perspective view of the cartridge of FIG. 1.
Figure 3:
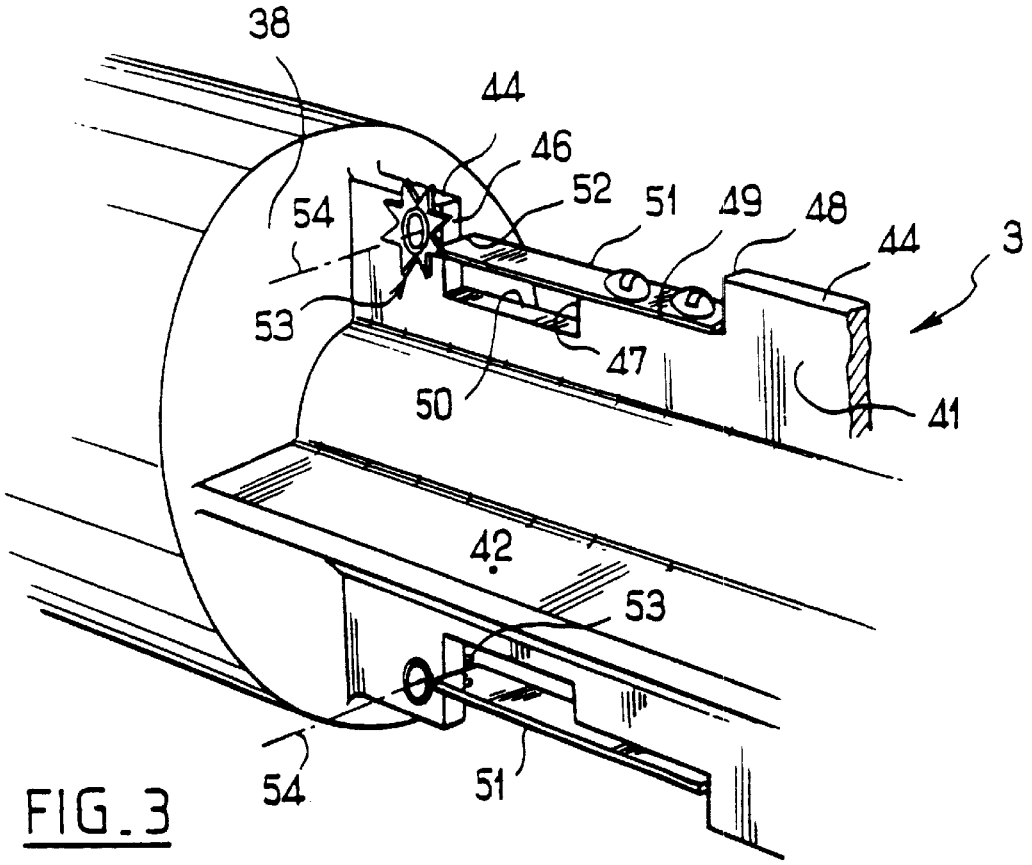
FIG. 3 is a partial perspective view of one of the spindles.

In FIG. 2, the cartridge can be seen in a more detailed manner and from the opposite side to that shown in FIG. 1. The cartridge comprises two plates 21 which are attached to each other by lateral half-walls 22 which produce two holes 23. The latter allow more ribbon to be wound onto each roller 4 without exceeding the maximum available space in the printer. This increases the autonomy of use of the cartridge. At the end of each of the lips a rotating cylinder 24 is fitted which allows the ribbon 8 to be guided without wear.

The front side of the cartridge 7 has a gripping member 26 to facilitate removal of the cartridge when its ribbon 8 is used up.

Figure 4:
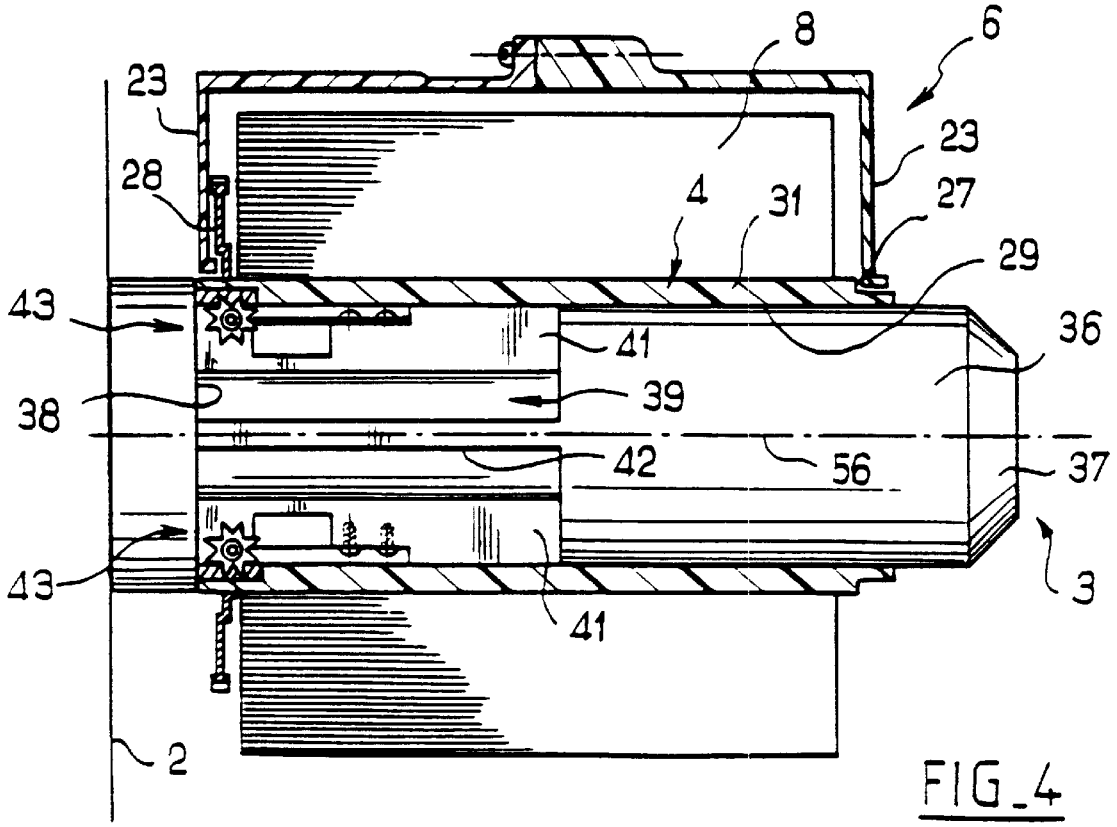
FIG. 4 is a plan view of one of the spindles of the printer with a partial section of the cartridge installed thereon.

In FIG. 4, the casing 6 is represented only in the top half of the figure. Each roller 4 includes at its front end a thinner section limited by a shoulder 27 which abuts against the inner side of the adjacent plate 23. At its rear end, each roller 4 includes a toothed locking wheel 28, the function of which will be explained below and which abuts against the inner side of the other plate 23. Thus the rollers 4 are trapped between the two plates 23 to prevent any axial movement relative to the casing 6, with the exception of operating play.

Figure 5:
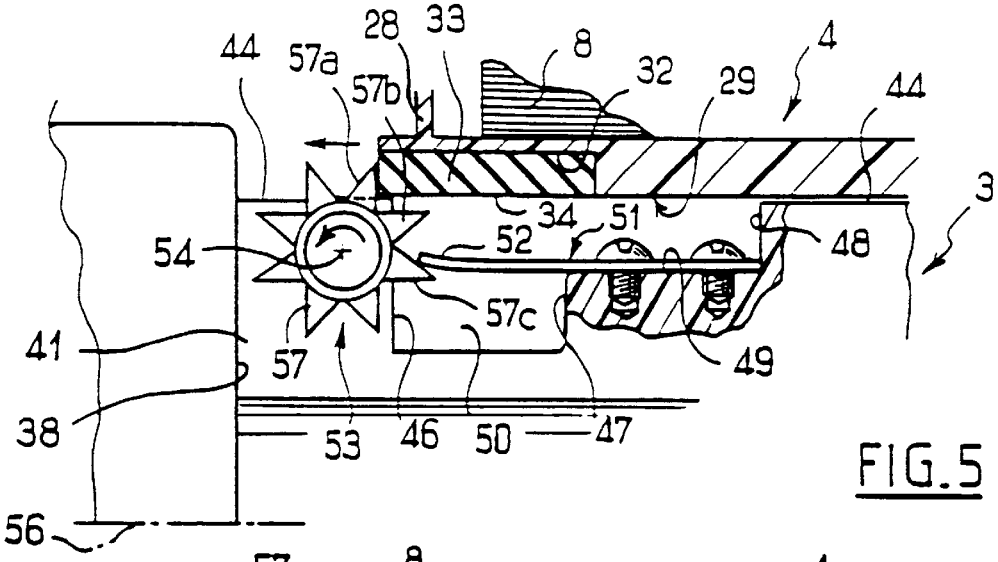
FIGS. 5 and 6 are detailed views illustrating the method according to the invention during the coupling operation between the ribbon roller and the spindle, and respectively at the end of this operation.
Figure 6:
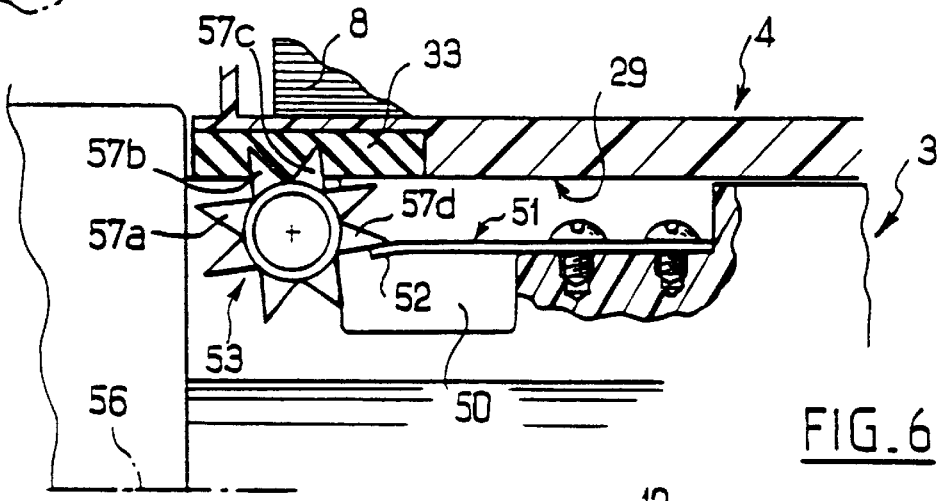

As shown in FIGS. 4, 5 and 6, each roller 4 has a cylindrical axial bore 29 defined over the greater part of its length by a substantially rigid tube 31 made of plastic. The tube 31 also defines the whole of the outer surface of the roller 4 as well as, in a single piece, the locking disc 28. At its rear end turned when in operation towards the interior of the housing 2 of the printer, the tube 31 exhibits an inner clearance 32 into which a ring made of soft material 33 is permanently fitted. The radially inner side 34 of the ring 33 is cylindrical and forms the rear end of the bore 29. The soft material of the ring 33 may consist of a soft, or flexible, plastic material, or of an elastomer.

Each spindle 3 exhibits a cylindrical outer surface 36 over a certain length from a conical free end 37, and a rear shoulder 38 which limits the penetration of the rollers 4. Recesses 39 separated by axial stiffening ribs 41 and 42 extend out between the shoulder 38 and the cylindrical outer wall 36. The ribs 41 and 42 have radially outer edges which extend the cylindrical surface 36 in order to ensure the centering of the rear region of the roller 4. The two ribs 41 which are diametrically opposite and located angularly halfway between the two ribs 42 additionally have a support function for means 43 for angular coupling with the roller 4. Each rib 41 has a cutout 50 in its radially outer edge 44 at a small distance from the shoulder 38. The cutout 50 is formed between a stepped section 46 on the side of the rear shoulder 38 and two successive stepped sections 47 and 48 on the other side. The stepped sections 47 and 48 are separated by a surface 49 which forms a securing plate for a fixed part of a spring blade 51. The free end 52 of the blade 51 points towards the stepped section 46. A wheel 53 is fitted freely pivoting on one of the lateral sides of each rib 41, along an axis 54 with a tangential direction relative to the axis 56 of the spindle, very close to the shoulder 38. The wheel 53 has pointed teeth 57 which are distributed regularly on its periphery in such a way that some of them (57*b* and 57*c* in FIG. 5) project into the cutout 50 between the stepped sections 46 and 47, and others (for example 57*a* in FIG. 5) project radially towards the exterior relative to the edge 44 and more generally relative to the cylinder defined by the surface 36 of the spindle 3. The free end 52 of the spring 51 interferes with the path of the teeth 57 in the cutout 50.

The operation of the means described up to now will now be explained, this description including that of the method according to the invention.

As shown in FIG. 5, irrespective of the angular position of the wheel 53, there is always a tooth 57*a* which projects beyond the edge 44 and which is the first tooth met by the leading edge of the roller 4 as it is being slid onto the spindle 3. This tooth 57*a* will act as an actuation stop for the rotational coupling operation. Indeed when the roller 4 is pushed further towards the left from the position shown in FIG. 5 in order to complete its insertion, the leading edge of the roller 4 pushes the tooth 57*a* which causes rotation of the wheel 53 and consequently penetration of the next tooth 57*b*, and even, as shown in FIG. 6, of the tooth 57*c* following that, into the soft material of the ring 33. These teeth constitute claws which penetrate the soft material of the ring 33 to then provide a rotational coupling between the roller 4 and the spindle 3 about the axis 56 when the roller 4 is in position (FIG. 6).

When the wheel 53 turns as mentioned above under the pressure of the roller 4 which is being inserted, a click is produced each time a tooth 57 crosses the free end 52 of the spring blade 51, with flexion and then release of the latter. These clicks give the person inserting the cartridge the impression of locking.

Once the roller 4 is in the operating position on the spindle 3 (FIG. 6), there is a tooth 57*d* which projects into the cutout 50 and which abuts against the free end of the blade 51 on the side preventing ready rotation of the wheel 53 in the direction corresponding to the release of the wheel 4 relative to the spindle 3 and to the movement of the teeth 57*c* and then 57*b* radially inwards. Thus the cartridge is firmly held in place in the position in which the ribbon 8 has an optimal path relative to the printing head. When the whole ribbon 8 of the cartridge has been consumed, removal of the cartridge is again accompanied by at least one click this time corresponding to unlocking.

Figure 7:
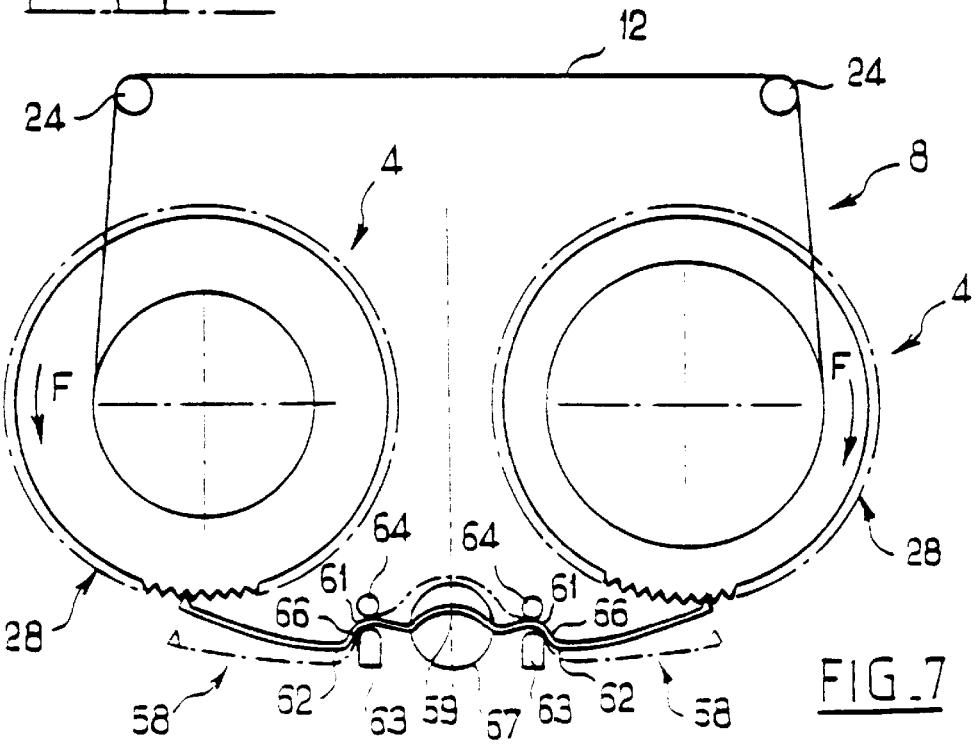
FIG. 7 is a front, schematic and partial view of the cartridge showing the disengageable locking means of the rollers.

As shown in FIG. 7, the disengageable locking means comprise, in addition to the toothed discs 28 (one per roller), two pawls 58 each interacting with the toothing of one of the discs 28 in order to prevent the corresponding roller 4 from rotating in the direction of release of the exposed region 12 of the ribbon 8. The two pawls 58 are opposite one another and are designed as a single spring blade with an actuation region 59 which connects them. On either side of the region 59 the blade exhibits a bend 61 and a counter-bend 62 in a region in which it passes between two bosses 63 and 64 of the casing. Each bend 61 and counter-bend 62 defines a shoulder 66. The two bosses 63, located between the two shoulders 66, prevent the spring blade from following a joint movement of the two discs 28 in one direction or the other, and therefore prevent the rollers 4 from both turning in the same direction. Therefore, when the two pawls are in the active position shown by a full line in FIG. 7, each roller 4 can only turn in one direction, opposite to that allowed for the other roller 4 (see the arrows F) and corresponding to an increase in the tension of the exposed region 12 of the ribbon 8.

During manufacture of the cartridge, a reasonable level of tension is given to the ribbon 8 and in particular to its exposed region 12, and this tension is maintained during transportation, storage and insertion of the cartridge thanks to the disengageable locking means which remain active for the whole of this period.

However, the actuation region 59 is positioned facing an orifice 67 in the rear plate of the casing. During insertion of the cartridge (FIG. 1), an actuating member 68 of the printer engages in the orifice 67 and moves the actuation region 59 (FIG. 7) as far as the position shown in dot-dash lines. Each pair of bosses 63, 64 then forms a pivot, and the pawls 58 assume the withdrawn position which is also shown in dot-dash lines and in which they are released from the toothing of the discs 28. The rollers 4 are then free to turn in the same direction, as this is necessary in order for one to take up the used ribbon while the other unwinds the still unused ribbon. In order to do this, one of the spindles 3, receiving the take-up roller, is connected to a driving motor, while the other, receiving the unwinding roller, is connected to a braking system which ensures a certain tension in the exposed region 12 of the ribbon 8 during printing. The driving torque and the braking torque are transmitted by the rotational coupling means 33, 53 which were described above.

Figure 8:
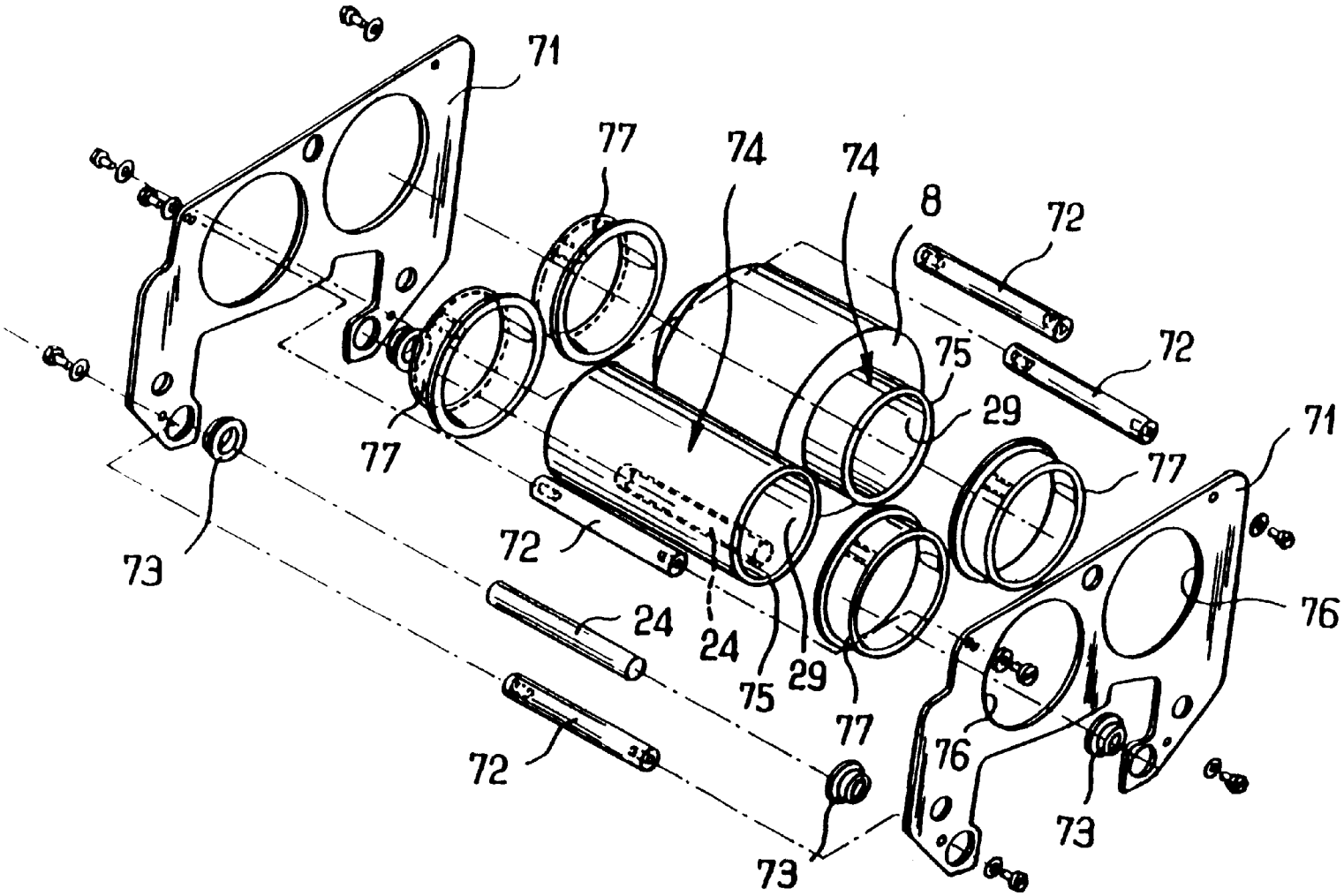
FIG. 8 is an exploded perspective view of a second embodiment of the cartridge.

In the embodiment shown in FIG. 8, which will only be described where it differs from that of FIGS. 1 to 7, the cartridge is produced more economically by two end plates 71 which are connected to each other by stiffening rods 72 which form a cage. The two guide cylinders 24 are trapped between the plates 71 by means of rings 73 forming a bearing. The rollers 74 are made entirely of soft material 75, and are simple tubes made of cardboard. In particular the cardboard 75 defines the bore 29 of the rollers 74. In order to rotationally fit these in the plates 71, the latter each have two circular holes 76 into each of which is slid a ring 77 made of plastic and having a certain axial length in order to limit the coefficient of friction and the pressure which each roller 74 is subjected to at each of its ends during its rotation.

When this cartridge is being inserted, it is the end of the cardboard roller which causes the rotation of the wheel 53 in FIGS. 3 to 6, thus causing the penetration of teeth such as 57*b* and 57*c* not into a ring 33 specially provided for this purpose as in FIG. 6, but into the cardboard constituting the whole of the roller 74.

For the purposes of simplification, no disengageable locking means are provided to keep the ribbon tight until the cartridge is inserted into the printer.

Figure 9:
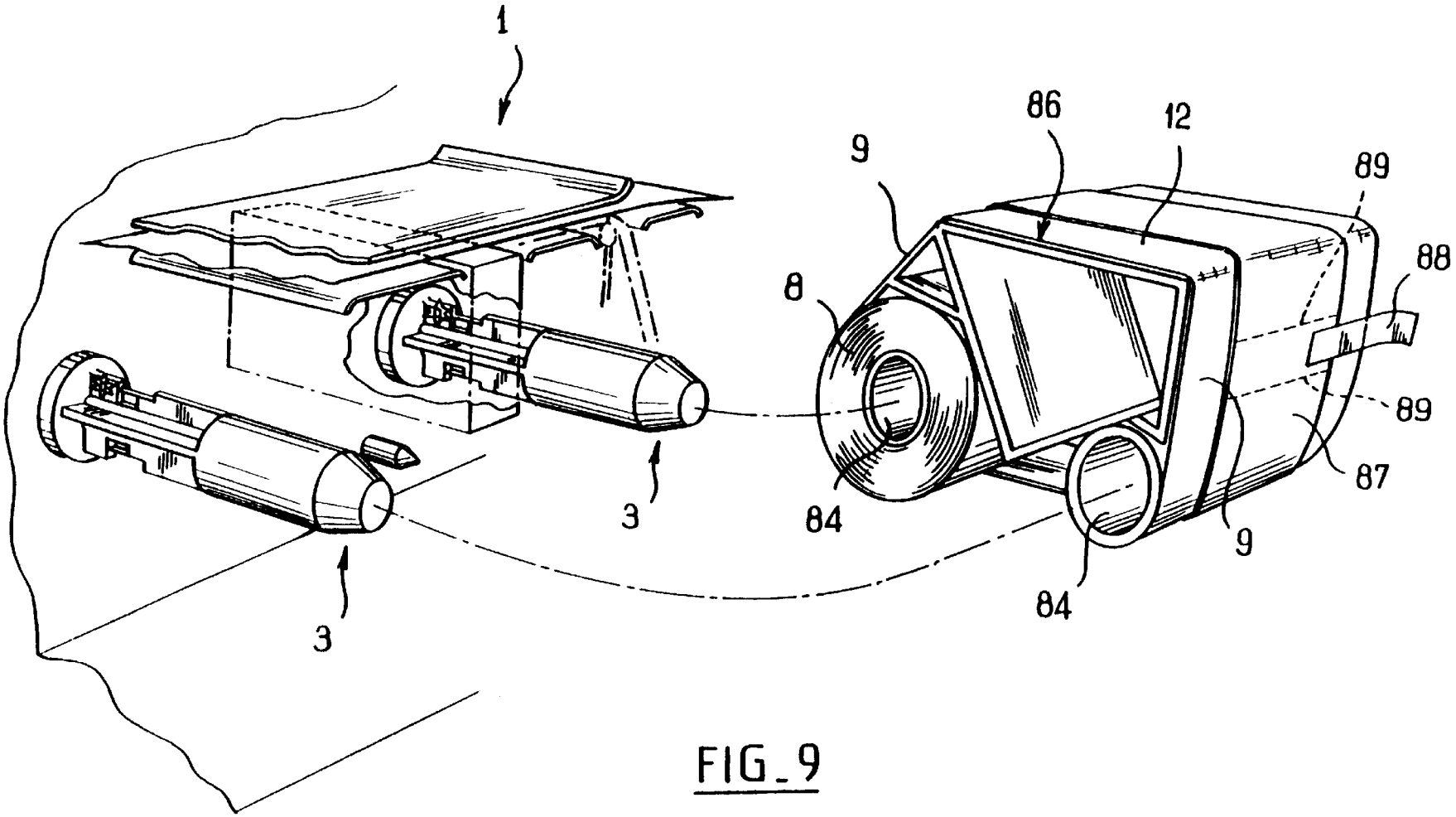
FIG. 9 is a similar view to FIG. 1 illustrating the insertion of a new ribbon using a disposable feeder.

FIG. 9 relates to a still more economical variant: there is no longer a cartridge, but simply two rollers 84 made of cardboard which are pre-installed in a disposable loader 86 likewise made of cardboard and having various walls parallel to the axis of the rollers 84. These walls position the two rollers 84 with, between their axes, a distance corresponding to that of the spindles 3 and position the regions 9 and 12 of the ribbon 8 in accordance with the path provided for them in the printer 1. A tightening strap 87 made of plastic provides the cohesion of the whole.

In order to replace the ribbon 8 in the printer 1, having removed the ribbon and the used rollers, the loader is introduced into the printer 1, the spindles 3 being slid into the cardboard rollers 84. Rotational coupling is brought about with the help of the wheels 53 as mentioned with regard to FIG. 8, the teeth of the wheel penetrating into the cardboard of the rollers 84. The tightening strap 87 is then removed by means of one or several strips 88 which allow the tightening strap 87 to be torn along one or several lines of weakness 89 provided during manufacture. The cardboard loader 86 can then be withdrawn and discarded (or the cardboard can be kept for recycling).

It is understood that, thanks to the invention, a single printer can receive refills which are very different from each other, provided that the rollers include a suitably situated soft part.

Of course the invention is not limited to the examples described and shown.

Instead of being carried out using claws, the rotational coupling could be carried out using corrugations or other projections capable of deforming the soft material without piercing it by means of claws The invention can be used with all apparatuses which consume ribbon. In the field of printers, it is not limited to ticket office printers.

I claim:

1. An interchangeable cartridge for use with a receiving apparatus having at least one spindle, said cartridge comprising a casing, two rollers which are rotationally supported in said casing, a ribbon which is wound at each of its ends onto a respective one of said rollers, each roller including an axial bore so that it can be slid onto one of the at least one spindle of the receiving apparatus, at least a first roller of said rollers including means for rotational coupling with the corresponding spindle, wherein said rotational coupling means comprise a soft material defining at least part of the bore of the first roller and said coupling means are configured to allow coupling irrespective of the angular position in which at least said first roller is engaged on the corresponding spindle.

2. The cartridge according to claim 1, wherein said first roller includes a ring made of soft material and a more rigid outer tube into which said ring is fitted.

3. The cartridge according to claim 1, wherein said soft material is cardboard.

4. The cartridge according to claim 3, wherein said first roller is made of cardboard.

5. The cartridge according to claim 1, wherein the soft material is a flexible, synthetic material.

6. The cartridge according to claim 3, wherein said cartridge comprises at least one face plate provided with holes, a bearing ring made of plastic fitted in at least one of said holes, and wherein said first roller has an end region made of cardboard and rotationally supported in said bearing ring.

7. The cartridge according to claim 1 comprising disengageable means for selectively preventing each roller from turning in a direction of tension release in the ribbon between the rollers.

8. The cartridge according to claim 7, wherein the disengageable means comprise two toothed wheels each of which is integral with a respective said roller, two pawls each of which interacts with a respective one of said two toothed wheels, said two pawls having an actuation portion which is exposed to external action.

9. The cartridge according to claim 8, wherein the two pawls are disposed opposite one another on either side of the actuation portion which is common to the two pawls and connects them to each other.

10. The cartridge according to claim 9, wherein said two pawls and the actuation portion are made up of a single spring blade which is supported in the casing in two positions which form pivoting axes and are situated on either side of the actuation portion.

11. A ribbon-carrier roller comprising a tube made of relatively rigid material and means for rotational coupling with a support spindle belonging to an apparatus capable of receiving said roller, wherein said rotational coupling means comprise a soft material which is fixed to the tube and defines at least part of the bore of the roller.

12. The roller according to claim 11, wherein said soft material is located at one end of the bore.

13. The roller according to claim 11, wherein said soft material is in the form of a ring slid into the relatively rigid tube.

14. A ribbon-consuming apparatus, comprising two parallel spindles at least one of which is a motor spindle, in order to simultaneously receive two rollers respectively for unwinding and for taking up a ribbon consumed by the apparatus, the motor spindle having means for rotational coupling with the corresponding roller, wherein the coupling means are configured to allow coupling irrespective of the angular position in which the corresponding roller is engaged on the motor spindle.

15. The apparatus according to claim 14, configured to receive a cartridge having a roller release means and rotationally supporting the two rollers, said apparatus including an actuator member which is positioned in the apparatus for engaging the roller release means of the cartridge upon insertion of the cartridge in the apparatus.

16. The apparatus according to claim 15, wherein said motor spindle has a cylindrical surface and a free end, and said coupling means are set back relative to said free end of the spindle and project radially relative to said cylindrical surface of the spindle.

17. The apparatus according to claim 16, wherein said motor spindle has a rear end remote from said free end and said coupling means are situated in the vicinity of said rear end of the spindle.

18. The apparatus according to claim 14, wherein the coupling means comprise clawing means.

19. The apparatus according to claim 18, wherein said clawing means comprise a toothed wheel mounted for rotation about a substantially tangential axis on the spindle in such a way that, in any angular position of the wheel before insertion of a ribbon roller, at least a first tooth of the wheel is in a position of being pushed by a roller being inserted, and that another tooth is in a position to operate as a claw which, by rotation of the wheel, will penetrate the material of the roller when the latter pushes the first tooth.

20. The apparatus according to claim 19, comprising a spring blade which is fixed to the spindle and has one free end which interferes with the teeth of the wheel.

21. The apparatus according to claim 19, comprising means for opposing a force against withdrawal of said another tooth from said position wherein it operates as a claw.

22. The apparatus according to claim 14, wherein said coupling means comprise ratcheting means which define for said roller in its motion of axial insertion onto the motor spindle, a position of higher resistance preceding a position of complete insertion.

23. The apparatus according to claim 14, said apparatus being a printer consuming ink ribbon.

24. A method of fitting two rollers, each supporting one of the ends of a ribbon, into a ribbon-consuming apparatus, provided with two spindles at least one of which is provided with a locking projection, said method comprising sliding said two spindles of the apparatus each into a central bore of one of the rollers, and during said sliding, bringing a soft wall portion of the bore of one of the rollers in a position to be penetrated by said projection.

25. The method according to claim 24 further comprising, during said sliding, pushing with a leading edge of said one roller a first tooth of a toothed coupling wheel provided on said one spindle, thereby to rotate said wheel and to move another tooth of said toothed wheel, into interference with said soft wall portion, said other tooth being used as said projection.

26. An interchangeable cartridge comprising a casing, two rollers which are rotationally supported in said casing, a ribbon which is wound from each of its ends on a respective one of said rollers, each roller including an axial bore so that it can be slid onto a spindle of a receiving apparatus, at least a first roller of said rollers including means for rotational coupling with the corresponding spindle wherein said first roller includes a ring made of soft material and a more rigid outer tube into which said ring is fitted, and wherein said rotational coupling means comprise said soft material, which defines at least part of the bore of the first roller.

27. The cartridge according to claim 26, wherein the soft material is a flexible, synthetic material.

28. The cartridge according to claim 26, comprising disengageable means for selectively preventing each roller from turning in a direction of tension release in the ribbon between said rollers.

29. The cartridge according to claim 28, wherein the disengageable means comprise two toothed wheels each of which is integral with a respective said roller, two pawls each of which interacts with a respective one of said two toothed wheels, said two pawls having an actuation portion which is exposed to external action.

30. The cartridge according to claim 29, wherein the two pawls are disposed opposite one another on either side of the actuation portion which is common to the two pawls and connects them to each other.

31. The cartridge according to claim 30, wherein said two pawls and the actuation portion are made up of a single spring blade which is supported in the casing in two positions which form pivoting axes and are situated on either side of the actuation portion.

32. An interchangeable cartridge comprising a casing, two rollers which are rotationally supported in said casing, a ribbon having two ends and which is wound from each of its ends on a respective one of said rollers, each roller including an axial bore so that it can be slid onto a spindle of a receiving apparatus, at least a first roller of said rollers including means for rotational coupling with the corresponding spindle, wherein said cartridge comprises at least one face plate provided with holes, a bearing ring made of plastic fitted in at least one of said holes, wherein said first roller has an end region made of cardboard and rotationally supported in said bearing ring, and wherein said rotational coupling means comprise said cardboard, which defines at least part of the bore of the first roller.

33. The cartridge according to claim 32, wherein said first roller is substantially wholly made of cardboard.

34. The cartridge according to claim 32, comprising disengageable means for selectively preventing each roller from turning in a direction of tension release in the ribbon between said rollers.

35. The cartridge according to claim 34, wherein the disengageable means comprise two toothed wheels each of which is integral with a respective said roller, two pawls each of which interacts with a respective one of said two toothed wheels, said two pawls having an actuation portion which is exposed to external action.

36. The cartridge according to claim 35, wherein the two pawls are disposed opposite one another on either side of the actuation portion which is common to the two pawls and connects them to each other.

37. The cartridge according to claim 36, wherein said two pawls and the actuation portion are made up of a single spring blade which is supported in the casing in two positions which form pivoting axes and are situated on either side of the actuation portion.

38. An interchangeable cartridge comprising a casing, two rollers which are rotationally supported in said casing, a ribbon which is wound from each of its ends on a respective one of said rollers, each roller including an axial bore so that it can be slid onto a spindle of a receiving apparatus, at least a first roller of said rollers including means for rotational coupling with the corresponding spindle, wherein said rotational coupling means comprise a flexible synthetic material which defines at least part of the bore of the first roller.

39. An interchangeable cartridge comprising a casing, two rollers which are rotationally supported in said casing, a ribbon which is wound from each of its ends on a respective one of said rollers, each roller including an axial bore so that it can be slid onto a spindle of a receiving apparatus, at least a first roller of said rollers including means for rotational coupling with the corresponding spindle, disengageable means for selectively preventing each roller from turning in a direction of tension release in the ribbon between said rollers, wherein the disengageable means comprise two toothed wheels each of which is integral with a respective said roller, two pawls each of which interacts with a respective one of said two toothed wheels, said two pawls having an actuation portion which is exposed to external action, the two pawls are disposed opposite one another on either side of the actuation portion which is common to the two pawls and connects them to each other, wherein said two pawls and the actuation portion are made up of a single spring blade which is supported in the casing in two positions which form pivoting axes and are situated on either side of the actuation portion, and wherein said rotational coupling means comprise a soft material defining at least part of the bore of the first roller.

40. The cartridge according to claim 39, wherein said soft material is cardboard.

41. The cartridge according to claim 40, wherein said first roller is made of cardboard.

42. The cartridge according to claim 39, wherein the soft material is a flexible, synthetic material.

43. A ribbon-carrier roller for use with an apparatus configured for receiving said roller, said roller comprising a tube made of relatively rigid material and means for rotational coupling with a support spindle belonging to the apparatus configured for receiving said roller, wherein said rotational coupling means comprise a soft material which is fixed to the tube and defines at least part of the bore of the roller, and wherein said soft material is in the form of a ring slid into the relatively rigid tube.

44. The roller according to claim 43, wherein said soft material is located at one end of the bore.

45. A ribbon-consuming apparatus for use with a ribbon mounted on at least one roller, said apparatus comprising two parallel spindles at least one of which is a motor spindle, in order to simultaneously receive two of the rollers respectively for unwinding and for taking up the ribbon consumed by the apparatus, the motor spindle having means for rotational coupling with the corresponding roller, wherein the coupling means comprise clawing means configured for allowing coupling irrespective of the angular position in which the corresponding roller is engaged on the motor spindle.

46. The apparatus according to claim 45, configured for receiving a cartridge rotationally supporting the two rollers, said apparatus including an actuator member which is positioned in the apparatus for engaging a roller release means of the cartridge upon insertion of the cartridge in the apparatus.

47. The apparatus according to claim 46, wherein said motor spindle has a cylindrical surface and a free end, and said coupling means are set back relative to said free end of the spindle and project radially relative to said cylindrical surface of the spindle.

48. The apparatus according to claim 47, wherein said motor spindle has a rear end remote from said free end and said coupling means are situated in the vicinity of said rear end of the spindle.

49. The apparatus according to claim 45, wherein said clawing means comprise a toothed wheel mounted for rotation about a substantially tangential axis on the spindle in such a way that, in any angular position of the wheel before insertion of a ribbon roller, at least a first tooth of the wheel is in a position to operate as a claw which, by rotation of the wheel, will penetrate the material of the roller when the latter pushes the first tooth.

50. The apparatus according to claim 49, comprising a spring blade which is fixed to the spindle and has one free end which interferes with the teeth of the wheel.

51. The apparatus according to claim 49, comprising means for opposing a force against withdrawal of said another tooth from said position to operate as a claw.

52. The apparatus according to claim 45, wherein said coupling means are configured to produce a ratchet motion of the roller onto the motor spindle, said roller encountering a position of higher resistance on the spindle when being slid onto the motor spindle.

53. The apparatus according to claim 45, said apparatus being a printer consuming ink ribbon.

54. A method of fitting two rollers, each supporting one of the ends of a ribbon into a ribbon-consuming apparatus provided with two spindles, at least one of which is provided with a locking projection, said method comprising: sliding said two spindles of the apparatus each into a central bore of one of the rollers, and during said sliding, bringing a soft wall portion of the bore of one of the rollers in a position to be penetrated by said projection, the method further comprising, during said sliding, pushing with a leading edge of said one roller a first tooth of a toothed coupling wheel provided on said one spindle, thereby to rotate said wheel and to move another tooth of said toothed wheel into interference with said soft wall portion, said other tooth being used as said projection.

* * * * *